United States Patent [19]

Vlacancinch

[11] 4,205,638

[45] Jun. 3, 1980

[54] FLUID POWER SUPPLY SYSTEM

[76] Inventor: Giovanni Vlacancinch, 14-36 132nd St., College Point, N.Y. 11356

[21] Appl. No.: 852,695

[22] Filed: Nov. 18, 1977

[51] Int. Cl.[2] ..... F02B 71/04; F04B 45/00

[52] U.S. Cl. ..... 123/46 A; 92/60; 123/19; 123/70 R; 123/71 R; 123/139 AJ; 417/380; 417/383

[58] Field of Search ..... 92/60; 417/364, 380, 417/383-388; 60/DIG. 1, 525; 123/19, 46 R, 46 A, 70 R, 71 R, 72, 74 R, 74 AC, 139 A, 139 H, 139 AJ

[56] References Cited

U.S. PATENT DOCUMENTS

| | | | |
|---|---|---|---|
| 1,860,784 | 5/1932 | Nelson | 123/139 AJ |
| 2,912,965 | 11/1959 | Campbell | 123/46 R |
| 2,983,098 | 5/1961 | Bush | 123/46 R |
| 3,172,596 | 3/1965 | King | 123/46 R |
| 3,694,111 | 9/1972 | Braun | 123/46 R |
| 3,841,797 | 10/1974 | Fitzgerald | 123/46 R |

FOREIGN PATENT DOCUMENTS

| | | | |
|---|---|---|---|
| 366046 | 9/1906 | France | 123/19 |
| 427668 | 8/1934 | United Kingdom | 123/46 R |

*Primary Examiner*—Charles J. Myhre
*Assistant Examiner*—Craig R. Feinberg
*Attorney, Agent, or Firm*—Posnack, Roberts, Cohen & Spiecens

[57] ABSTRACT

A double acting Diesel cycle hot gas engine comprising a plurality of engine cylinders, each having a free piston unit adapted to perform work, providing a continuous flow of compressed air to an energy consumption source and to a storage tank connected therewith. The free piston unit includes an air compression piston and a power piston, spaced apart from each other and adapted to move together within each respective engine cylinder through a connecting rod extended therebetween in response to the movement of a working medium under a substantially constant pressure acting against one side of the power piston and to the pressure and expansive power generated by the burning gases of an air fuel mixture acting on the opposite side of said power piston. Cycle control means are provided to release the potential energy accumulated within the working medium which is initially used to drive the power piston to compress the air fuel mixture and thus, initiating the operative cycle of the engine. The working medium is arranged into a hermetic compartment including a free floating piston adapted to perform work. The compartment has a volumeric capacity variable in response to the movement of the free piston unit within the engine cylinders, whereby energy in the form of compressed air is obtained through the movement of the free floating piston and the air compression piston respectively simultaneously and independently one from the other.

22 Claims, 3 Drawing Figures

FLUID POWER SUPPLY SYSTEM

FIELD OF THE INVENTION

The present invention relates to a fluid power supply system adapted to produce energy which may be used, for instance, to propel a motor vehicle; to operate a power plant or for ship propulsion, and more particularly to a pressure loaded exchange engine, preferably of the Diesel type, wherein energy in the form of compressed air is produced simultaneously in at least two independent compressed air producing sources driven by the pressure loaded exchange engine in such a way that a continuous flow of compressed air produced in one source is supplied to an energy consumption source, while the compressed air produced in the other source is stored into a storage tank for future use, to improve the performance of the engine or to supply additional power to another energy consumption source connected therewith.

Furthermore, the present invention provides reliable and accurate cycle control means adapted to control the power outlet of the system by controlling the operative cycle of the engine in such a way that the latter will be only in operation when the amount a pressure of compressed air required at the energy consumption source decreases within non-operative values.

PRIOR ART

The prior art available teaches a variety of devices and machines adapted to improve the performance and operation of internal combustion engines such as disclosed in U.S. Pat. Nos. 3,353,520; 3,406,666; 3,443,551; 3,450,109; 3,687,119 and 3,698,365. However, none of the above mentioned patents show or suggest the unique combination of two independent compressed air producing sources simultaneously driven by the energy produced by the expansion of the burning fuel and air mixture within the internal combustion chamber of the pressure exchange engine.

SUMMARY OF THE INVENTION

The invention described herein discloses an internal combustion engine, preferably of the Diesel type, having a free piston unit adapted to use the energy stored up in a working medium arranged within a hermetic compartment under a substantially constant measure, to compress a fuel air mixture injected into the combustion chamber of the engine, when the restraining forces are released, whereby the energy generated by the combustion of the fuel air mixture, is used to exert a driving pressure to a free floating piston through the working medium, and to an air compression piston, which forms integral part of the piston unit, for performing work simultaneously and independently. As the result of the work performed by the free piston unit and the free floating piston, fresh air admitted previously into separated air compression chambers is compressed by the action of said pistons and supplied to an energy consumption source and to a storage tank for future use to improve the performance of the engine by injecting supercharged air into the combustion chamber of the engine.

OBJECTS OF THE INVENTION

The main object of the present invention is to provide means for supplying power in the form of compressed air to an energy consumption source such as for instance, a gas powered turbine which may be adapted to propel a motor vehicle, boats, air powered machines or may be used to produce electric energy in power plants.

A further object of the present invention is to provide control means for starting the operative cycle of the internal combustion engine which are tripped or released automatically to release the potential energy accumulated in the working medium, whereby compressed air will be delivered to the energy consumption source and to a storage tank through a pair of independent compressed air producing means operatively connected to the internal combustion engine, when the demand for more power is required at the energy consumption source or when the pressure of the compressed air decreases at dangerous levels making the operation of the turbine inoperative and ineffective.

It is another object of my invention to provide a free moving piston unit which includes an explosion or power piston and an air compression piston spaced apart from each other, adapted to move together through a shaft or connecting rod extended therebetween, whereby the pistons move together within separated chambers at the same time to perform work in at least 3-way directions.

Another object of my invention is the provision of a working medium, subjected to a substantially constant pressure, which is housed within a sealed compartment having a volumetric capacity variable in response to the movement of the free piston unit and which is adapted to use the pressure and expansive power generated by the burning gases at the end of the power stroke of the power piston for producing additional power in the form of compressed air to be stored up whereby the performance of the internal combustion engine is improved.

These and other objects and advantages of the present invention will become apparent upon reading the following description, of which the attached drawings form a part.

DETAILED DESCRIPTION

Figure 1:
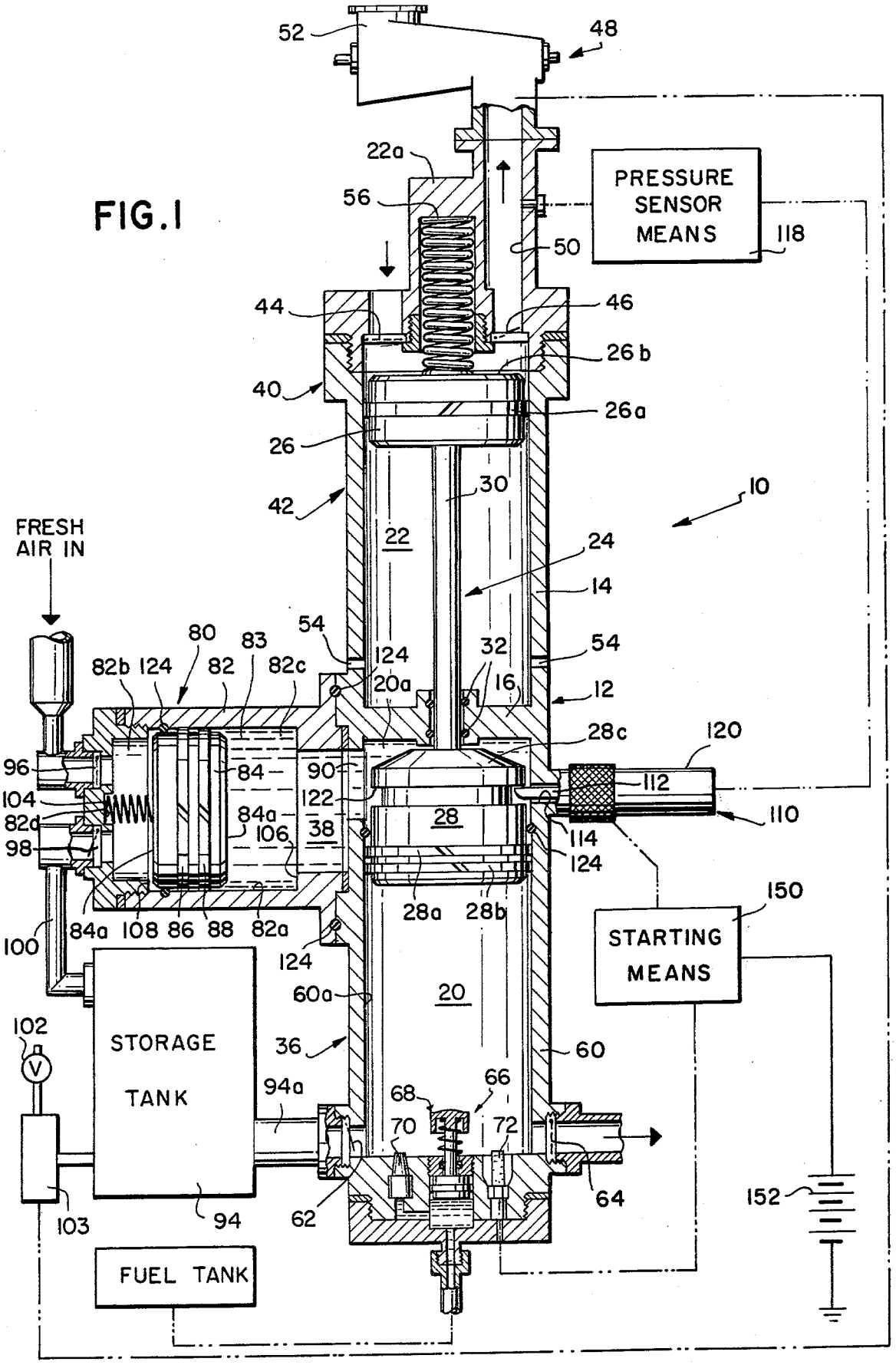
FIG. 1 illustrates a schematic, elevational cross sectional view of the fluid power supply system of my invention, wherein the structural relationship between the free piston engine and the air compressors is clearly shown.

Referring now to FIG. 1, the fluid power supply system 10 of the present invention comprises an elongated cylinder block 12 having a housing 14 with a wall or partition means 16 therein separating the housing 12 into diametrically opposed air compression chamber 22 and combustion chamber 20, wherein a free piston unit 24 is adapted to move axially when the power supply system of the present invention is in operation.

The free piston unit 24 comprises an air compression piston 26 and a power piston 28 connected together through a connecting rod or shaft 30 which extends through an aperture provided in wall 16. Adequate packing or oil seal means 32 is provided around the aperture to prevent any leakage of fluid from chamber 20 to chamber 22, or vice versa, during the operation of the power supply system 10. The chamber 20 constitutes the internal combustion chamber of the free piston engine 36 which uses the Diesel cycle, while the chamber 22 constitutes the air compression chamber of an air compressor unit or compressed air producing means 40. The air compression piston 26 is equipped with ring 26*a* to press against the cylinder wall of the air compression chamber 22 of the air compressor unit 34, preventing air from escaping through the small space between the cylinder wall and the piston 26.

The explosion piston or power piston 28, which is an integral part of an internal combustion engine 36, is equipped with compression rings 28*a* and scraper rings 28*b* to press against the cylinder wall of the combustion chamber 20.

Compression rings 28*a* seal the combustion chamber 20 against the leakage of air and vaporized fuel during the compression stroke of the engine 36. Oil or scraper rings 28*b* control the amount of oil on the cylinder wall of a chamber 38 defined between the partition wall 16 and a portion 28*c* of the pistion 28.

The air compressor unit 40 comprises a cylinder block 42 including an intake valve 44 which controls the flow of fresh air into the compression chamber 22; and an exhaust valve 46 which controls the flow of compressed air out of the chamber 22 into an energy consumption source 48 through a discharge conduit 50. A gas turbine 52 is arranged at the energy consumption source 48, which may be conveniently adapted to propel a vehicle or other air powered machines not shown in the drawings.

A bleeding or purging aperture 54 is provided near the partition wall 16 to facilitate the flow of air out of the chamber 22 during the intake stroke of the piston 26, which is spring-loaded through an expansion spring 56 arranged within chamber 22, between the top 26*b* of the piston 26 and the upper end 22*a* of the air compression chamber 22.

The internal combustion engine 36 which is preferably a double acting Diesel cycle hot gas engine type, comprises a cylinder block 60 having an intake valve 62 which controls the flow of compressed air into the combustion chamber 20; an exhaust valve 64 which controls the flow of burned gases out of the combustion chamber 20 into the atmosphere; a fuel injection pump 66 arranged within the path of the working piston 28 including a spring-loaded plunger 68, whereby the correct amount of fuel for burning into the chamber 20 will be sprayed therein by a fuel injector 70 and a glow plug 72 to effect easy starting of the engine, by preheating the cylinder walls thereof.

A second compressor or compressed air producing means 80 is operatively associated with the internal combustion engine 36 for simultaneously storing up compressed air which may be used to improve the performance of the engine 36. The compressor 80 comprises an elongated cylinder 82 having a free floating piston 84 adapted to move axially within the cylinder walls 82*a* of the cylinder 82. The piston 84 divides the cylinder 82 into an air compression chamber 82*b* and a drive chamber 82*c* and it includes a compression face 84*a* and a driving face 84*b*. Furthermore, the piston 84 is equipped with compression rings 86 and scraper rings 88 to press against the cylinder walls 82*a*. The elongated cylinder 82 may be mounted perpendicularly to the cylinder blocks 12 and 42, as shown in FIG. 1, or it can be designed as an independent part of the block. However, it is important that the drive chamber 82*c* must be located adjacent and close to an aperture 90 provided in the cylinder wall 60*a* which connects the drive chamber 82*c* with the low pressure side 20*a* of chamber 20.

A working medium or fluid 83 is arranged within the drive chamber 82*c* for reciprocation of the piston 84 and pumping compressed air into a storage tank 94, after the air-fuel mixture is fired within the combustion chamber 20. An air inlet valve 96 in communication with the atmosphere is properly arranged in the high pressure side of the cylinder 82 which controls the flow of fresh air coming into the air compression chambers 82*b*. An exhaust valve 98 is also provided on the same side of the cylinder 82 which controls the flow of compressed air into the storage tank 94 through a conduit 100 connected therebetween. The storage tank 94 may include a relief valve 102 for safety reasons, and a distributing valve 103 connected to said energy consumption source 48.

A return spring 104 is mounted between the compression piston face 84*a* and a lateral wall 82*d* of cylinder 82 adapted to move the piston 84 against a shoulder 106 provided within the drive chamber 82*c* to limit the axial movement thereof into said chamber 82*c*. The chamber 82*b* also includes a stop member 108 near the wall 82*d* to control the axial movement of the piston 84 during the compression of new fresh air coming into the compression chamber 82*b*.

The power supply system of the present invention also provides means 110 to effectively control the operation of the engine 36, arranged in such a way that the position of the power piston 28 is always adjacent to wall 16, due to the combustion of the air-fuel mixture whereby the expanding hot gas will drive the piston 28 close to wall 16, at the end of the power stroke. Such control means 110 comprises a spring-loaded sliding or blocking member 112 adapted to be extended through a slot 114 into cylinder block 12 across chamber 20*a* when the pressure and quantity of compressed air has reached satisfactory values such as to operate, for instance the gas turbine 52, so that the cycle of the internal combustion engine 36 is interrupted. This action is automatically controlled by providing a pressure sensor device 118 electrically connected to the sliding member 112 through a pressure actuating member 120 which will be set up to oppose the pressure ejected by the working fluid 83 during the power stroke of the piston 28.

The portion 28*c* of the working piston 28 is provided with a groove or shoulder 122 adapted to cooperate with sliding member 112 in such a way that the free end thereof will engage under the groove 122 for blocking the axial movement of the power piston 28 when there is no need for power in the form of compressed air at the intake of the gas turbine 52. As it can be seen in FIG. 1 and FIG. 2 the portion 28*c* may be a slightly slanted surface 28*d* which cooperates with the free end of the sliding member 112 to slide the same outwardly out of the chamber 20*a* against the pressure actuating member 120 which will hold member 112 through convenient means (not shown) until the pressure sensor device 118 establishes the contrary, due to a drop in value in the compressed air coming into the air intake of the turbine 52.

A plurality of O-ring members 124 are provided within the combustion chamber 20, air compression chamber 22 and driving chamber 82*c* to insure a substantially hermetic enclosure, whereby the possibility of leakage of the working medium 83 from the above mentioned chambers is greatly reduced.

The power piston 28 includes pressure stabilizing means 130 (FIG. 3) adapted to restore the pressure within chamber 20*a* during the power stroke of piston 28, if the pressure inside chamber 82*c* reaches uncontrollable values harmful for the safe operation of the power supply system 10.

Figure 3:
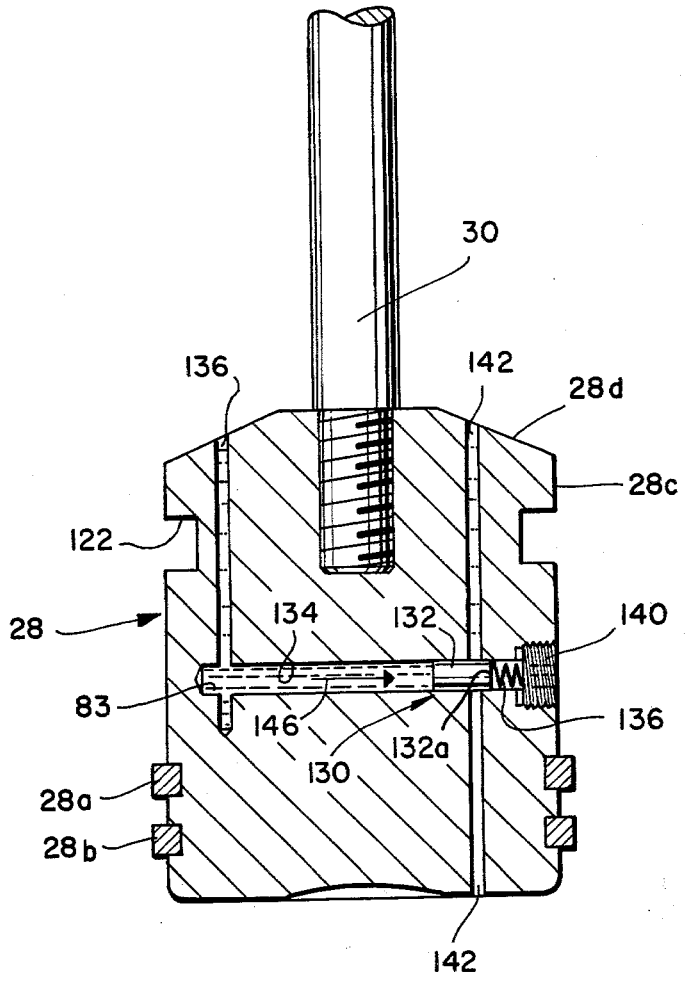
FIG. 3 is a cross sectional view of the cylinder of the free piston engine showing the structural features of the pressure stabilizing means of my invention.

The pressure stabilizing means 130 comprises a springloaded blocking plug or member 132 arranged within a passageway 134 to move axially in opposite directions in accordance with the pressure transmitted to the working medium 83, since the passageway 134 communicates with the chambers 20*a* and 82*c* respectively through a passageway 136. An expansion spring 138 is placed between one end 132*a* of the member 132 and a removable plug 140. Furthermore, the piston 28 includes a longitudinal passage 142 extended through the entire length thereof which intersects passageway 134. The passage 142 which connects chamber 20*a* to the combustion chamber 20, most of the time, remains blocked by the member 132, as shown in FIG. 3, during the normal operation of the internal combustion engine 36.

However, when the pressure transmitted to the working fluid 83 reaches unpredictable values, the member 132 will be forced to move in the direction indicated by the arrow 146, against the spring 138 for unblocking passageway 142 and bleeding freely working fluid 83 into chamber 20, whereby the pressure transmitted to the working medium will be reduced.

A vehicle (not shown) provided with the power means above described may be cheaply built up since a minimum number of parts is required. The internal combustion engine 36 has no connecting rod, cranshaft, or fly-wheel. This reduction on parts constitutes a great advantage over the conventional automobiles.

In operation, a starting device 150 is provided in the fluid power system of my invention which controls the operation of the internal combustion engine 36.

The starting device 150 is electrically connected to a battery 152 which will provide the necessary electric power to start the engine. Since the structural features of the starting device 150 forms no part of my invention, its details have not been shown in the accompanying drawings. However, for a better comprehension of the operation of my invention , it will suffice to mention that the device 150 may include a solenoid valve (not shown) operatively connected to the pressure actuating member 120 through a switch key provided in the dashboard of the vehicle.

Figure 2:
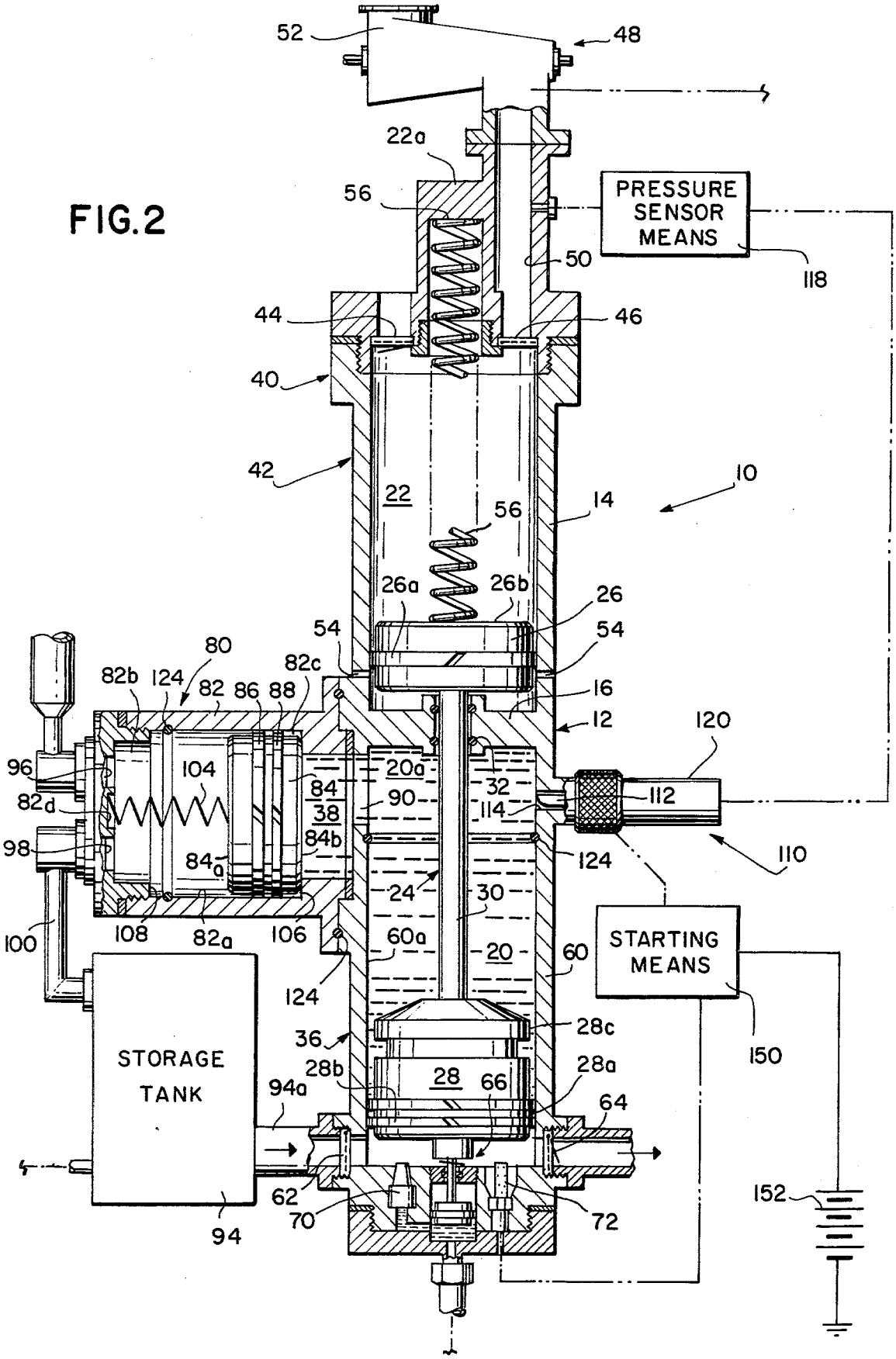
FIG. 2 shows a similar view to FIG. 1 but some of the moving parts of the system are illustrated in a different position.

When the switch is turned on the solenoid valve is energized whereby the member 112 will move to the right, as shown in the drawings, (see FIG. 2 and maintained in that position as long as the internal combustion engine 36 is in operation).

The piston unit 24 will move away from partition wall 16 to compress the air already in the combustion chamber 20 until it reaches the pressure required for combustion with the fuel which will be injected into the combustion chamber 20 as soon as the power piston 28 hits the plunger 68, fuel will be sprayed through the injector 70, at the right time for combustion of the fuel-air mixture.

Due to the power generated by the combustion, the hot expanding gases will drive the free piston unit 24 towards the partition wall 16. During the movement of the piston unit 24 to compress the air fuel mixture, fresh air charges will flow into air compression chambers 82*b* and 22 of the compressor 80 and air compressor unit 40, respectively, through the inlet valves 96 and 44 which will remain open until the free piston unit 24 moves toward the partition wall 16 after combustion. Simultaneously, the working medium 83 will be forced to occupy the space left by the free piston 28 because the internal pressure in chamber 20*a* is substantially reduced to increase the volumetric capacity of the working fluid 83, whereby the floating piston 84 will move until it hits the shoulder 106. This movement is also accomplished by the energy stored in the expansion spring 104.

After the explosion of the fuel-air mixture, the free piston unit 24 will drive the air compressor unit 40 through the connecting rod 30 and the compressor 80 through the working medium 83. As it was mentioned earlier, the charge of fresh air already in the air compression chambers 22 and 82*b* will be compressed by the pistons 26 and 84 respectively as the result of the movement of the free piston unit. The outlet valves or exhaust valves 46 and 98 are calibrated to be opened when the pressure of the compressed air reaches a predetermined value, which is required to drive the turbine 52. The compressed air obtained through the pressure compessor 80 is stored up into the storage tank 94 conveniently mounted in the chassis of the vehicle. The storage tank 94 includes a conduit 94*a* in communication with the air inlet valve 62. The operation or cycle of the internal combustion engine 36 is repeated until the capacity of the storage tank 94 is completed. This operation may be completed preferably before the vehicle is propelled by the turbine 52 to get the pressure and amount of compressed air required to improve the performance of the internal combustion engine 36.

Obviously, modifications in form and structure may be made without departing from the spirit of the present invention.

What is claimed is:

1. The combination of a machine driven by compressed air and a power supply system for supplying compressed air to said machine to drive the same, said power supply system comprising:

(a) first and second compressor means for simultaneously producing compressed air, said first compressor means being operatively connected to said machine to supply compressed air thereto, (b) means for driving said first and second compressor means when the compressed air pressure decreases within pre-established values at said machine, (c) cycle control means coupled to said driving means for controlling the operation of said driving means in response to the pressure of the compressed air being supplied to said machine from said first compressor means, (d) means including a mechanical coupling between said driving means and said first compressor means and a working medium establishing pressure coupling between said driving means and said second compressor means for effecting independent but simultaneous operation of said first and second compressor means in accordance with operation of said driving means, and (e) said cycle control means including blocking means for holding said driving means (1) in a stationary position in which the working medium is under pressure and acts on the driving means and (2) for releasing said driving means such that under the pressure of said working medium operation of said driving means is initiated.

2. The power supply system according to claim 1 wherein said machine includes a power producing turbine adapted to propel a motor vehicle.

3. The power supply system according to claim 1, wherein said driving means comprises an internal combustion engine.

4. The power supply system according to claim 3, wherein said internal combustion engine is a Diesel cycle hot gas engine.

5. The power supply system according to claim 4, wherein said Diesel cycle hot gas engine comprises:

(i) a main engine having a free piston unit adapted to perform work and, thus, providing a continuous flow of compressed air to said machine, said piston unit including a pair of axially spaced apart pistons adapted to move together within said main engine cylinder through a connecting rod extended therebetween, said pistons dividing said main engine cylinder into an air compression chamber, adapted to receive atmospheric air at one end thereof, an intermediate chamber containing said working medium under pressure and a combustion chamber adapted to receive a fuel air mixture;

(ii) wall means interposed between said air compression chamber and said intermediate chamber including oil seal means which slidably receives said connecting rod; a housing having a secondary cylinder in communication with said intermediate chamber; and (iii) a free floating piston arranged within said secondary cylinder and substantially defining a hermetic compartment in cooperation with said intermediate chamber for performing work after the burning of said fuel air mixture in said combustion chamber.

6. The power supply system according to claim 5, wherein said main engine cylinder includes inlet and exhaust means for controlling the fluid flow, in and out of said air compression chamber, said exhaust means being in communication with said machine.

7. The power supply system according to claim 5 wherein said main engine cylinder includes atmospheric releasing means adjacent to said wall means for purging the air within said air compression chamber below said air compression piston during the downward movement of said piston unit.

8. The power supply system according to claim 5, said cycle control means further including pressure sensor means arranged between said air compression chamber adjacent to said exhaust means and said machine for detecting the amount and pressure supplied to said source, said pressure sensor means being operatively connected to said blocking means for releasing the same to initiate the operative cycle of the internal combustion engine.

9. The power supply system according to claim 5 wherein said combustion engine includes means for supplying a metered charge of fuel within said chamber, said means being actuated by said power piston during the compression of said air fuel mixture.

10. The power supply system according to claim 9, wherein said fuel supplying means comprises a metered fuel container connected to a fuel tank having a predetermined amount of fuel; a nozzle operatively connected to said contrainer through a conduit extended therebetween; a spring loaded plunger adapted to move within said container and in contact with said fuel surface, said plunger having a portion thereof projected within the path of said power piston whereby a metered charge of fuel will be injected into said combustion chamber during the downward movement of said power piston.

11. The power supply system according to claim 5, where said hermetic compartment contains said working medium under a predetermined pressure, cooperating against one side of said floating piston in equilibrium with resilient means mounted at the opposite side thereof.

12. The power supply system according to claim 11, wherein said working medium is a mixture of oil and air under a substantially constant pressure.

13. The power supply system according to claim 11, wherein said hermetic compartment has a volumetric capacity variable in response to the movement of said free piston unit.

14. The power supply system according to claim 5, wherein said pair of spaced apart pistons constitute respectively an air compression piston of said first compressor means and a power piston of said internal combustion engine, said air compression piston being adapted to move within said air compression chamber from a position adjacent to said inlet and exhaust means to a position close to said wall means during the movement of said power piston.

15. The power supply system according to claim 14, wherein said free floating piston constitutes an air compression piston of said second compressor, said secondary cylinder comprising inlet and exhaust means at one end thereof for controlling the fluid flow in and out of said secondary cylinder, said exhaust means being in communication with storage tank means for storing compressed air coming out of said exhaust means.

16. The power supply system of claim 15, wherein said storage tank means is in communication with said combustion chamber for injecting a charge of compressed air simultaneously with a fuel charge, during the compression stroke of said power piston, and for injecting another charge of compressed air after the burning of the air fuel mixture and thus removing the burned gases from the combustion chamber.

17. The power supply system according to claim 15, wherein said storage tank means includes a relief valve means and a distributing valve means for directing the excess of said compressed air accumulated in said storage tank to said machine which is connected therewith.

18. The power supply system according to claim 14, wherein said power piston has a peripheral groove, said blocking means including at least one blocking member adapted to be extended within said groove for maintaining said piston in a stationary, inoperative condition.

19. The power supply system according to claim 18, wherein said cycle control means further includes a pressure actuating device operatively connected to said blocking member in opposition to the pressure exerted by said working medium during the stationary condition of said driving means and a starting device electrically connected to a battery and to said pressure actuating device for starting the operating cycle of said internal combustion engine by releasing the blocking member from said groove whereby the power piston will be driven to compress the air fuel mixture introduced into the combustion chamber.

20. The power supply system according to claim 18, wherein said power piston is shaped to act on said blocking member to displace the same to inoperative position when the power piston travels in its power stroke, said blocking member remaining in inoperative position provided the pressure of the compressed air supplied to said machine exceeds a pre-determined value.

21. The power supply system according to claim 18, wherein said power piston further includes stabilizing pressure means adapted to release said working medium from said hermetic compartment to said combustion chamber for releasing the pressure buildup accumulated in said hermetic compartment during the movement of said piston unit.

22. The power supply system according to claim 21 wherein said stabilizing pressure means comprises a spring loaded plug housed within a passage extending in said power piston, a longitudinal passage extended longitudinally along the entire length of said power piston for connecting the hermetic compartment with said combustion chamber, said spring loaded plug being interposed at the intersection of said passages for blocking the longitudinal passage during the compression of said air fuel mixture.

* * * * *